US005719541A

United States Patent [19]

Mader

[11] Patent Number: 5,719,541

[45] Date of Patent: Feb. 17, 1998

[54] RELAY

[75] Inventor: Leopold Mader, Mödling, Austria

[73] Assignee: Eh-Schrack Components-Aktiengesellschaft, Vienna, Austria

[21] Appl. No.: 499,589

[22] Filed: Jun. 7, 1995

[30] Foreign Application Priority Data

Jul. 8, 1994 [AT] Austria ..... 1353/94

[51] Int. Cl.[6] ..... H01H 51/22

[52] U.S. Cl. ..... 335/78; 200/17 R

[58] Field of Search ..... 200/17 R, 275; 335/78, 80, 83, 84, 87, 106, 107, 121, 127, 128–133, 185–204

[56] References Cited

U.S. PATENT DOCUMENTS

| | | | |
|---|---|---|---|
| 3,819,896 | 6/1974 | Aidn et al. | 200/166 J |
| 3,885,115 | 5/1975 | Schrotter | 200/245 |
| 4,220,835 | 9/1980 | Storz et al. | 200/67 DB |
| 4,600,909 | 7/1986 | Willson | 335/133 |
| 5,144,270 | 9/1992 | Schedele et al. | 335/80 |
| 5,396,204 | 3/1995 | Matsuoka et al. | 335/78 |

FOREIGN PATENT DOCUMENTS

| | | | |
|---|---|---|---|
| 2561436 | 9/1985 | France | H01H 51/22 |
| 2627168 | 12/1977 | Germany | H01H 50/56 |
| 7833522 | 2/1982 | Germany | H01H 50/56 |
| 4115092 | 11/1992 | Germany | H01H 50/04 |
| 4232227 | 4/1993 | Germany | H01H 50/56 |
| 9303437 | 8/1993 | Germany | H01H 50/56 |
| 4316285 | 12/1993 | Germany | H01H 50/64 |
| 9315891 | 12/1993 | Germany | H01H 50/56 |

*Primary Examiner*—Michael L. Gelliner
*Assistant Examiner*—Michael A. Friedhofer
*Attorney, Agent, or Firm*—Henry M. Feiereisen

[57] ABSTRACT

A relay includes a base member; a magnetic system mounted on the base member and including an armature, a contact arrangement with a contact spring formed with a contact piece, and an actuating element coupled to the armature for transmitting armature movement to the contact spring. The armature element is linked to the contact spring at attack points between which the contact spring has zones of different configuration whereby the magnetic system is loaded substantially evenly upon actuation of the contact spring.

63 Claims, 6 Drawing Sheets

RELAY

BACKGROUND OF THE INVENTION

The present invention refers to a relay, and in particular to a relay having a magnetic system with an armature, a contact arrangement with a moving contact spring provided with at least one contact piece, and an actuating element coupled to the armature for transmitting armature movement to the contact spring.

Relays of this type have generally contact springs which are operated during attraction of the armature only after overcoming a prestress which vary in accordance to the selected type of relay. In order to keep the required energy to activate the relay as low as possible and to simplify its production, it is advantageous to render the overtravel or overstroke in the relay as great as possible. This requires contact springs of soft spring characteristic, which can be accomplished by providing the contact spring with a relatively great longitudinal deflection. The shortcoming of such a construction is the necessity to build the relay with great dimensions which evidently is not conducive to an aspired miniaturization. Therefore, attempts were made to increase the overtravel of the contact spring by e.g. bending the contact spring out of the contact plane. However, all methods of this type cause problems during production, and moreover result in a uneven loading of the armature so that the switching behavior of the relay is adversely affected.

SUMMARY OF THE INVENTION

It is an object of the present invention to provide an improved relay obviating the afore-stated drawbacks.

In particular, it is an object of the present invention to provide an improved relay which is characterized by small dimensions with a greatest possible overtravel while best utilizing the power reserve generated by the magnetic system to create highest possible contact forces.

It is another object of the present invention to provide an improved relay by which greatest possible contact forces are generated without unevenly loading the magnetic system while yet allowing a free selection of the element to transfer the force from the actuating element onto the contact arrangement.

It is yet another object of the present invention to provide an improved relay which accomplishes a secure switching operation during actuation of the contact spring.

It is still another object of the present invention to provide an improved relay in which the force transfer from the magnetic system, in particular from the armature, onto the contact spring does not adversely affect the switching frequency and service life of the relay.

These objects and others which will become apparent hereinafter are attained in accordance with the present invention by providing the contact spring with zones of different properties between the attack points of the actuating element and the contact piece, with the magnetic system, in particular the armature, being symmetrically or evenly loaded upon actuation of the contact spring.

By providing the contact spring with zones of different spring characteristics, e.g. soft and hard spring characteristic, the overtravel can be increased while keeping the relay of small dimensions without significantly altering the assembly of the relay and without adversely affecting the contact-making capability. Moreover, by selecting the location and dimensions of the zones of the contact spring, the force transmission can be best suited. The different configuration of the contact spring enhances the switching safety of the contacts, whereby the symmetric loading of the magnetic system avoids wear of the mechanics during repeated actuation of the contacts.

According to another feature of the present invention, the contact spring is formed with at least one aperture which partially encloses the contact piece. Thereby, zones of different spring characteristic can be realized in a simple manner. Preferably, the aperture is formed as cutout which extends from an edge of the contact spring inwardly. By forming the contact spring with a cutout which is thus open on one end, the contact springs is afforded different spring characteristics while the relay can be built at even smaller dimensions.

In addition, it may be advantageous to provide in the area of the clamping end of the contact spring to the base member an approximately rectangular hole. Thus, a web is formed between the aperture and the hole to create an improved overall arching of the contact spring about its longitudinal axis when being actuated so that during contacting the contact piece executes a defined roll-off motion which positively affects the switching behavior as the contacts are not marred by corrosion or scaling.

Preferably, the aperture begins in an area above the contact piece and terminates in an area below the contact piece to thereby achieve a particular advantageous distribution of differently formed zones so that the overtravel of the relay is maximized.

Further, it may also be possible to form the cutout such as to extend from the upper edge of the contact spring and laterally of the contact piece and to terminate in an area below the contact piece. Also this results in a very advantageous sectioning of the contact spring to increase the overtravel. Suitably, the end of the cutout that is positioned in the contact spring may be formed with an enlargement so that the transmission of the effective force of the actuating element can be modified and an unbalanced distribution of the forces acting upon the magnetic system can be offset. The enlargement may be formed asymmetrical with respect to the longitudinal axis of the contact spring. This further improves the load balance of the magnetic system.

In accordance with a another embodiment of the present invention, the attack points of the actuating aliment may be formed through cutouts in the contact spring, with lugs being bent outwards in form of a bell flare as in a trumpet. This configuration of the attack points improves the guidance of the actuating element because, compared to simple apertures, the lack of any sharp edges eliminates attrition which could contaminate the contacts and increase the contact resistance.

Suitably, the base member is divided by partition walls to form upwardly open compartments for receiving the contact spring and the fixed contact carriers and separating them from each other. Thus, creeping current paths are extended and creeping currents are prevented.

According to another feature of the present invention, the contact spring may be secured in the base member via two legs extending laterally at the lower end of the contact spring, at formation of a transverse web to support the arching effect of the contact spring. Alternatively, the contact spring may be secured in the base member via only a central leg that extends from the lower end of the contact spring. Also this configuration supports the arching of the contact spring.

According to still another feature of the present invention, the contact piece may have a center which is offset with respect to the longitudinal axis of the contact spring. Thereby, the roll-off motion of the contact spring during contacting is supported.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
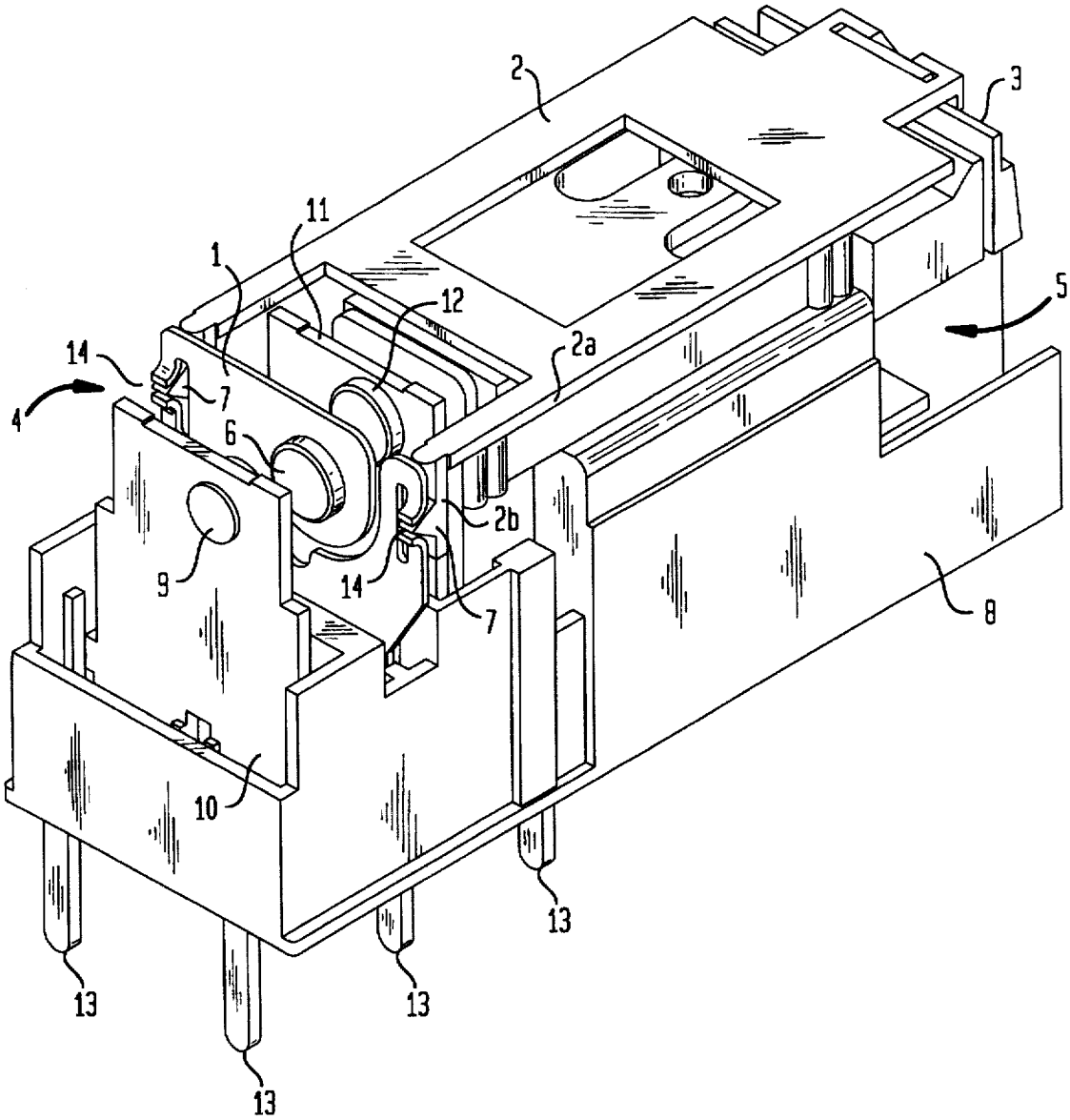
FIG. 1 is an axonometric illustration of one embodiment of a relay according to the present invention.

Throughout all the Figures, the same or corresponding elements are always indicated by the same reference numerals.

Turning now to the drawing, and in particular to FIG. 1, there is shown an axonometric illustration of a relay according to the present invention, including a magnetic system, generally designated by reference numeral 5 and a contact arrangement, generally designated by reference numeral 4. The magnetic system 5 includes an armature 3 which is operated by a suitable motor (not shown). It will be appreciated by persons skilled in the art that the magnetic system 5 must contain much additional apparatus which does not appear in the foregoing figures. For example, the magnetic system includes a coil and a yoke. However, this apparatus, like much other necessary apparatus, is not part of the invention, and has been omitted from the figures for the sake of simplicity.

The contact arrangement 4 is composed of a moving contact spring 1 and fixed contact carriers 10, 11. Both, the magnet system 5 and the contact arrangement 4 are mounted on an insulated base member 8, which may be made from plastic material, with the armature 3 extending at one end face of the base member 8, and the contact spring I extending at the other end face thereof between the two stationary contact carriers 10, 11. The contact spring 1 is provided at a suitable location on each side thereof with a bead-like contact piece 6 for cooperation with a bead-like contact piece 9 of the contact carrier 10 and a bead like contact piece 12 of the contact carrier 11.

The magnetic system 5 further includes an actuating element or pusher 2 in form of a flat comb or card for transmitting the movement of the armature 3 to the contact spring 1 to thereby contact one or the other of the contact pieces 9, 12 of the contact carriers 10, 11. In the released state of the armature 3, the contact piece 12 of the contact carrier 11 is in conducting connection with the contact piece 6 of the contact spring 1, while the contact piece 9 of the contact carrier 10 contacts the contact piece 6 of the contact spring 1 when the armature 3 is attracted. It will be appreciated by persons skilled in the art that the contact spring 1 may also include several such contact pieces 6.

At its end that is secured to the contact spring 1, the pusher 2 is provided with lateral prolongations 2*a* to thereby exhibit a forked configuration. Extending downwards from each prolongation 2*a* is a leg 2*b* which supports a lug 7 that engages an opening 14 at the upper end of the moving contact spring 1.

The contact carriers 10 and 11 and the contact spring 1 are further provided with terminal pins 13 which extend through the base member 8.

Figure 2:
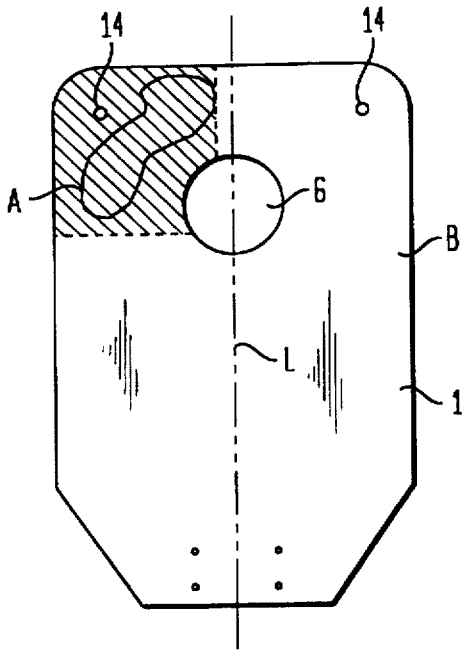
FIGS. 2 to 8 show front plan views illustrating various embodiments of a contact spring for use in a relay according to the present invention.

Turning now to FIG. 2, there is shown one embodiment of a contact spring 1 according to the present invention. The contact spring 1 is divided in two zones designated A, B between the attack points 14 of the pusher 2 and the contact piece 6, with the attack points 14 constituting the attachment of the lugs 7 within the opening 14. In accordance with the present invention, the zones A, B have different characteristics, e.g. zone A may be hardened while zone B may be formed of soft spring material. This can be achieved for example by a treatment that is restricted only to the marked boundaries of zone A and/or zone B of the contact spring 1, e.g. through application of a laser. The configuration of the zones A, B can be selected in dependence on prevailing conditions and requirements, with the degree of hardness being accordingly selected.

By forming zones of different spring characteristics, the overtravel of the contact spring 1 is increased because the area carrying the contact piece 6 is not moved parallel to the deflection of the contact spring 1 during actuation the pusher 2; but the e.g. soft zone B will cause an arching of the contact piece 6 about the longitudinal axis L of the contact spring 1, and an opening of the contact between the stationary contact piece 12 of the contact carrier 11 (not shown in FIG. 2) whereby the armature overtravel is noticeably increased.

Figure 3:
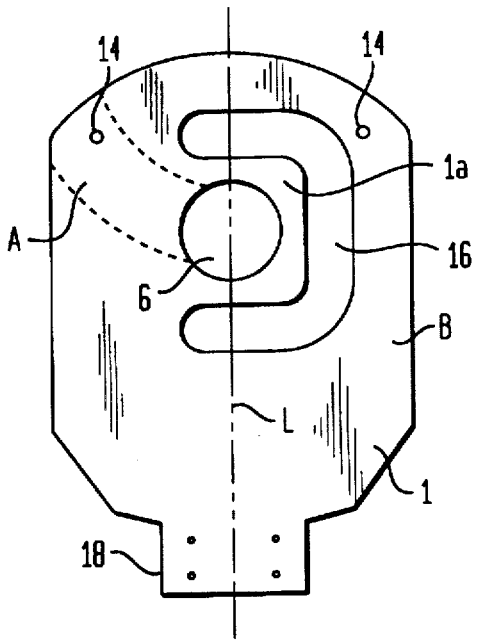

FIG. 3 shows a further embodiment of a contact spring 1 in accordance with the present invention, with the contact spring 1 including an aperture 16 which partially surrounds the contact piece 6 in a C shaped configuration to thereby disengage the contact piece 6 from one of the attack points 14 (here the attack point on the right-hand side). The aperture 16 starts from an area above the contact piece 6 and extends laterally around the contact piece 6 to terminate in an area below the contact piece 6. Thus, the contact piece 6 is supported by a projecting section 1*a* of the contact spring 1 which extends preferably perpendicular to the longitudinal axis L.

The zone A of the contact spring 1 extends from one attack point 14 of the pusher 2 towards the contact piece 6 and has a relative hard spring characteristic in view of the short distance between the attack point 14 and the contact piece 6. This relatively hard spring characteristic corresponds to a conventional overtravel during actuation of the contact spring 1. The other designated zone B forms a longer distance for connecting the other attack point 14 and the contact piece 6, and therefore has the property of a soft spring. Thus, upon actuation, areas of the contact spring 1 arch transversally to the longitudinal axis L of the contact spring 1. During attraction and release of the armature 3, the arching pattern is formed in opposite manner. The thus increased overtravel or force build up is generated by twisting the contact spring 1 transversely to the longitudinal axis. The created roll-off motion is advantageous for effecting a proper contacting because the contamination of the contact pieces through corrosion or scaling can be kept small. Also, the roll-off motion prevents a fusion of the contact pieces when operating with high currents.

Figure 4:
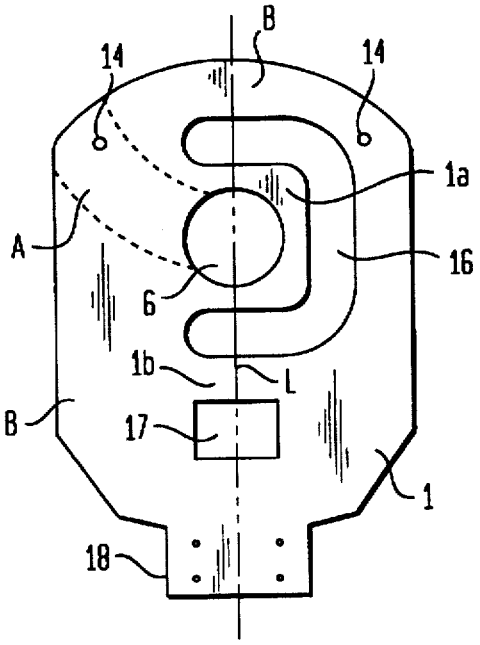

FIG. 4 shows a variation of a contact spring 1 of FIG. 3, with the difference residing in the additional provision of an approximately rectangular hole 17 in the area of the lower end of the contact spring 1 that is anchored within the base member 8. Thus, a web 1*b* is formed between the aperture 16 and the hole 17 to improve or reinforce the arching effect of the contact spring 1 about its longitudinal axis L so that during contacting, the contact piece 6 executes a defined roll-off motion which positively affects the switching behavior as the contacts are not marred by corrosion or scaling.

Figure 5:
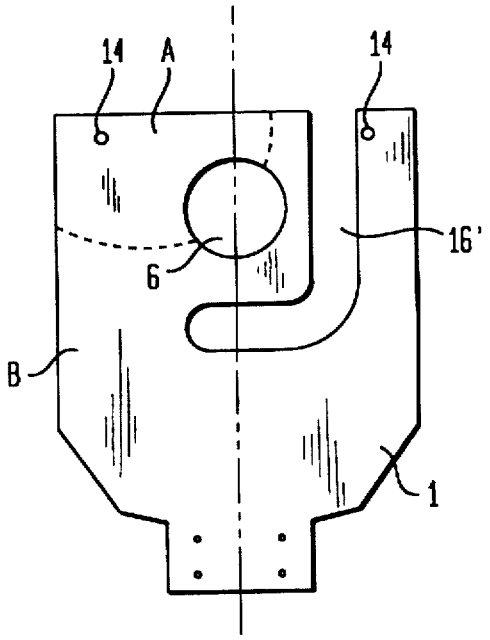

FIG. 5 shows another embodiment of a contact spring 1 according to the present invention, which differs from the previous embodiments by the formation of an aperture 16' which extends from the upper edge of the contact spring 1 inwardly and laterally around the contact piece 6 to terminate below the contact piece 6. The aperture 16' separates the zone B of soft spring characteristic from the zone A of hard spring characteristic. This embodiment results in a relay of very small dimensions as the section of the contact spring 1 above the contact piece 6 is reduced so that the overall height of the contact spring 1 is significantly shorter compared to the embodiments shown in FIGS. 3 and 4.

Figure 6:
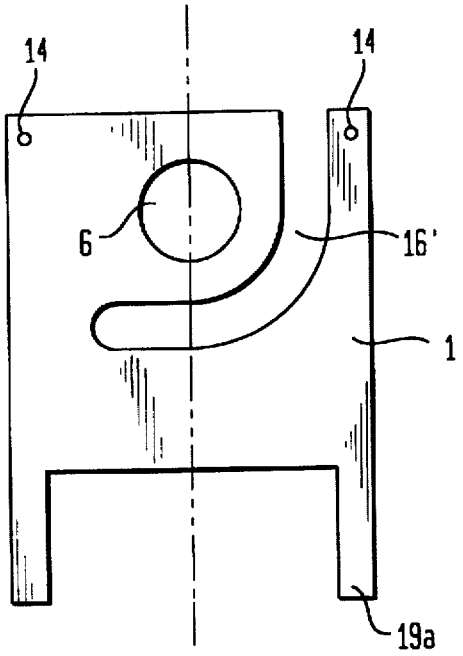

The contact springs 1 shown in FIGS. 3 to 5 have a lower end representing a central clamping area 18 which is riveted to the base member 8, with the contact spring 1 being actuated at the attack points 14 and twisted relative to the clamping area 18. FIG. 6 shows an embodiment of the contact spring 1 with modified clamping area that includes two narrow legs 19 projecting from the lower end of the contact spring 1 for securement in the base member 8 of the relay. The aperture 16' is configured in the same manner as in FIG. 5. This form of attachment supports the arching effect and thus the advantageous roll-off motion of the area that carries the contact piece 6.

Figure 7:
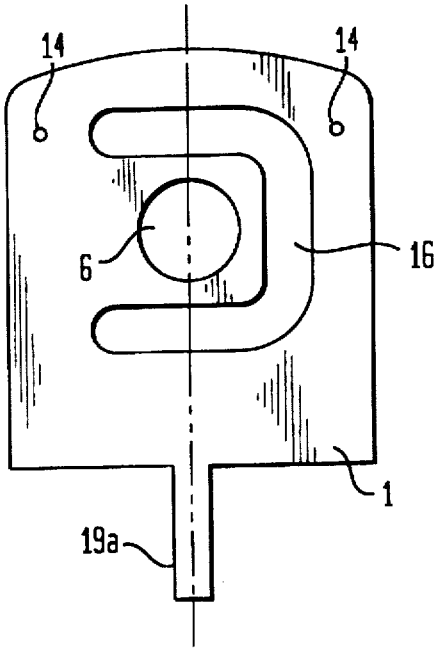

FIG. 7 shows a variation of the clamping area of FIG. 6 with only a single central leg 19*a* at the lower end of the contact spring 1.

Figure 8:
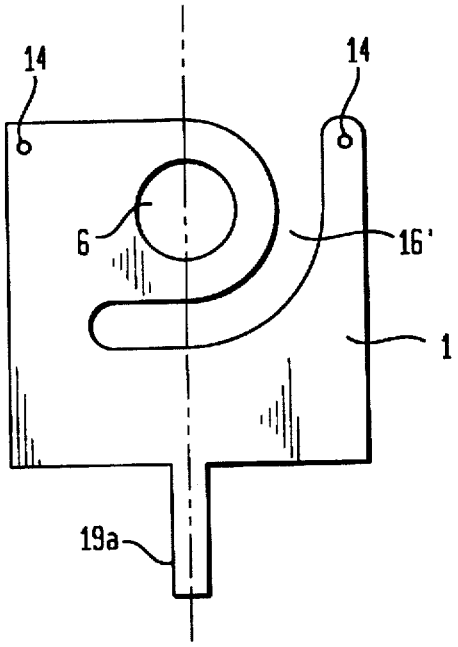

FIG. 8 shows a contact spring 1 which is similar to the contact spring 1 in FIG. 7 except for the provision of the cutout 16' instead of an aperture 16 so as to create a relay of smaller dimensions.

Figure 9A:
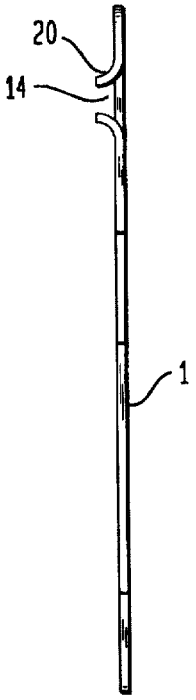
FIG. 9*a* is a side view thereof.
Figure 9:
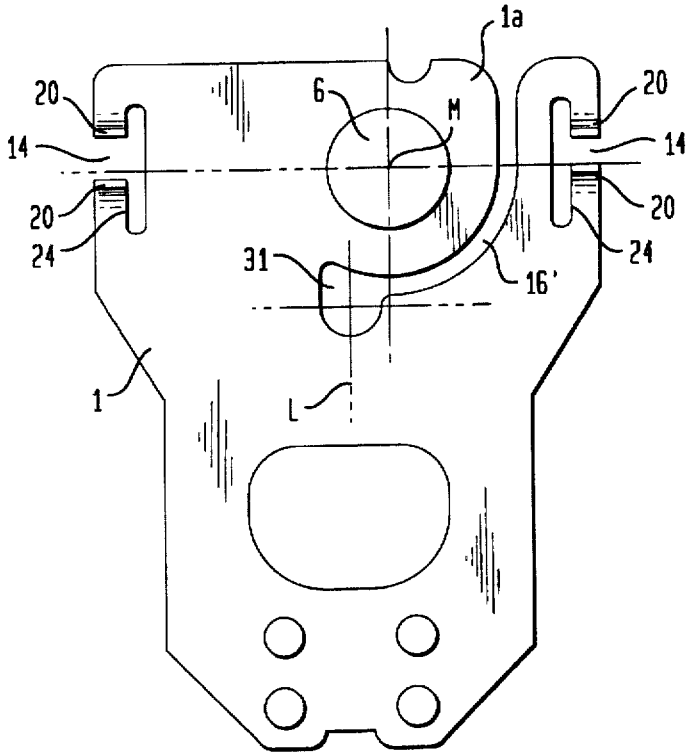
FIG. 9 is a front plan view of a further embodiment of a contact spring for use in a relay according to the present invention.

FIG. 9 shows a variation of a contact spring 1 according to the present invention in which the attack points 14 of the pusher 2 are formed by cutouts 24, that extend inwardly from the outer edge, with lugs 20 being bent outwardly in form of a bell flare, as best seen in FIG. 9*a*. The lugs 7 of the pusher 2 engage the arched lugs 20 to thereby attain a particularly attrition-free connection of the leg 2*b* of the pusher 2 with the contact spring 1 and a defined guidance thereof. The aperture 16' is routed to the longitudinal axis L of the contact spring 1 and the inward end of the aperture 16' is provided with an enlargement 31. The contact piece 6 is positioned such that its center M is offset to the longitudinal axis L to create an improved roll-off motion during actuation of the contact spring 1 by the pusher 2.

Figure 10A:
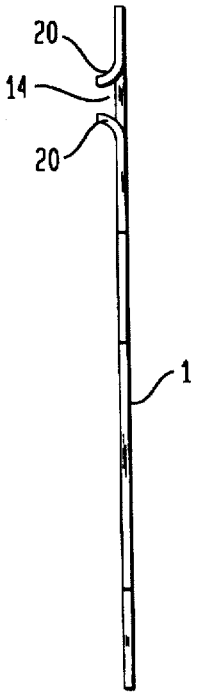
FIG. 10*a* is a side view thereof.
Figure 10:
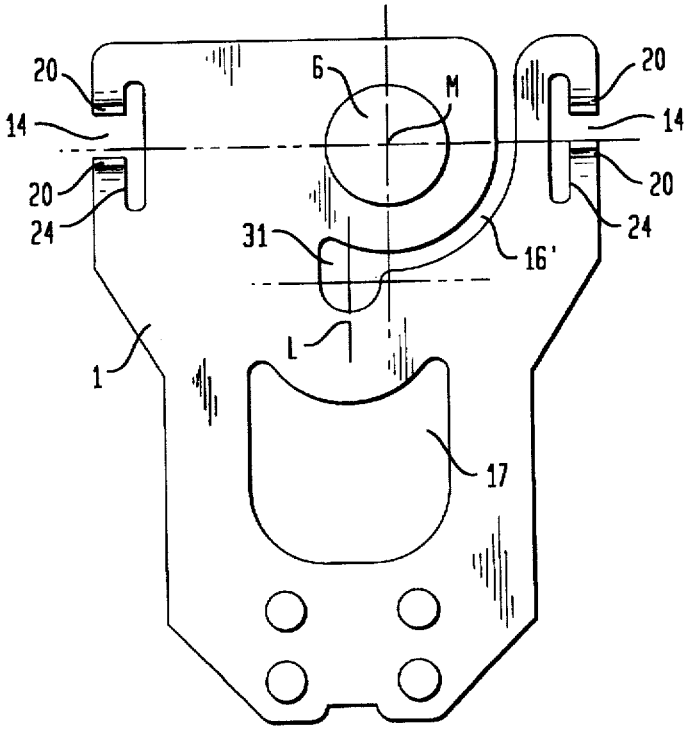
FIG. 10 is a front plan view of still another embodiment of a contact spring for use in a relay according to present invention.

The embodiment of a contact spring 1 according to FIG. 10 differs from the embodiment in FIG. 9 by the arrangement of a hole 17 positioned at the lower end of the contact spring 1 and having round edges to further support the roll-off motion. FIG. 10*a* shows a side view of the contact spring 1 to illustrate again the configuration of the lugs 20 in form of a bell flare.

Figure 11:
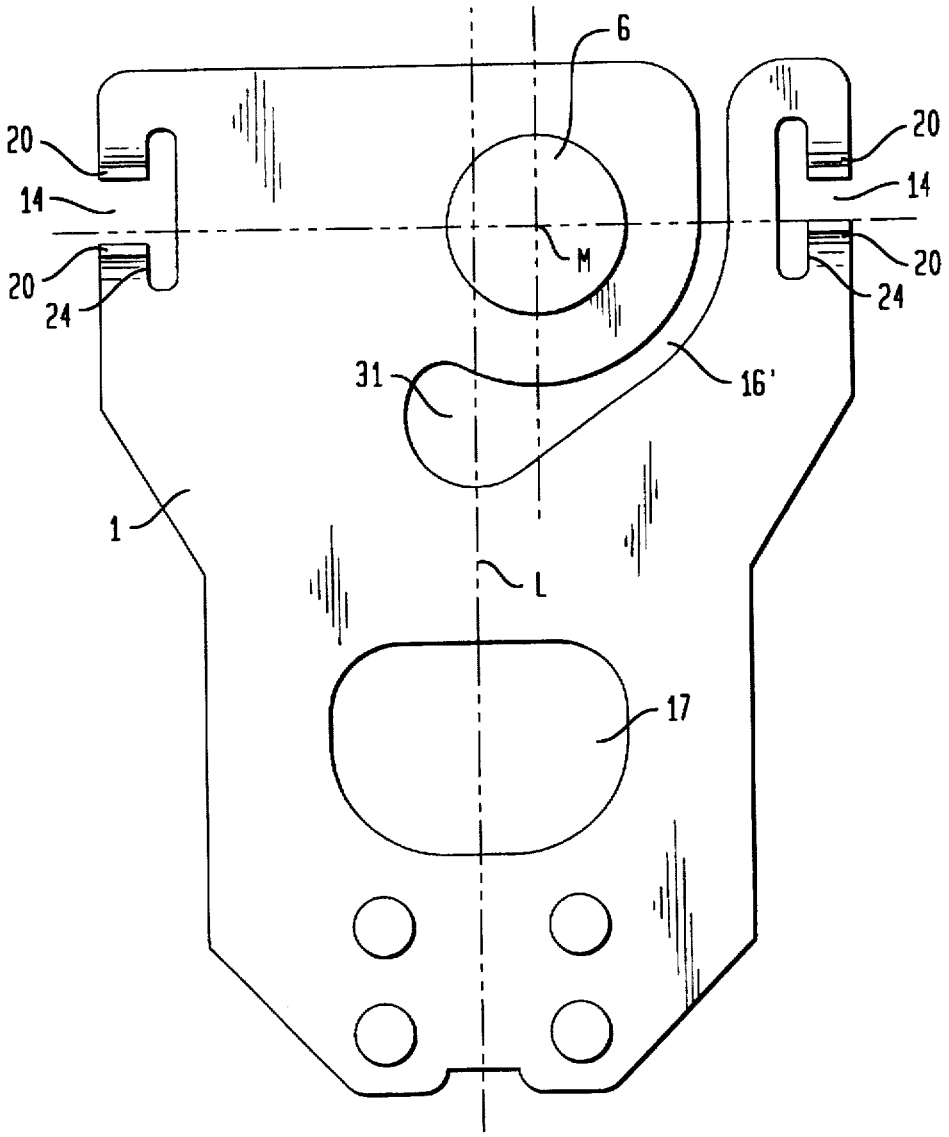
FIG. 11 is a front plan view of yet another embodiment for a contact spring for use in a relay according to the present invention.

The variation according to FIG. 11 shows a contact spring 1 with an enlargement 31 at one end of the aperture 16', with the aperture 16' extending asymmetrically to the longitudinal axis L. This configuration of the end zone of the aperture 16' offsets the unbalanced distribution of forces acting within the contact spring 1 so that the magnetic system is evenly loaded.

Figure 12:
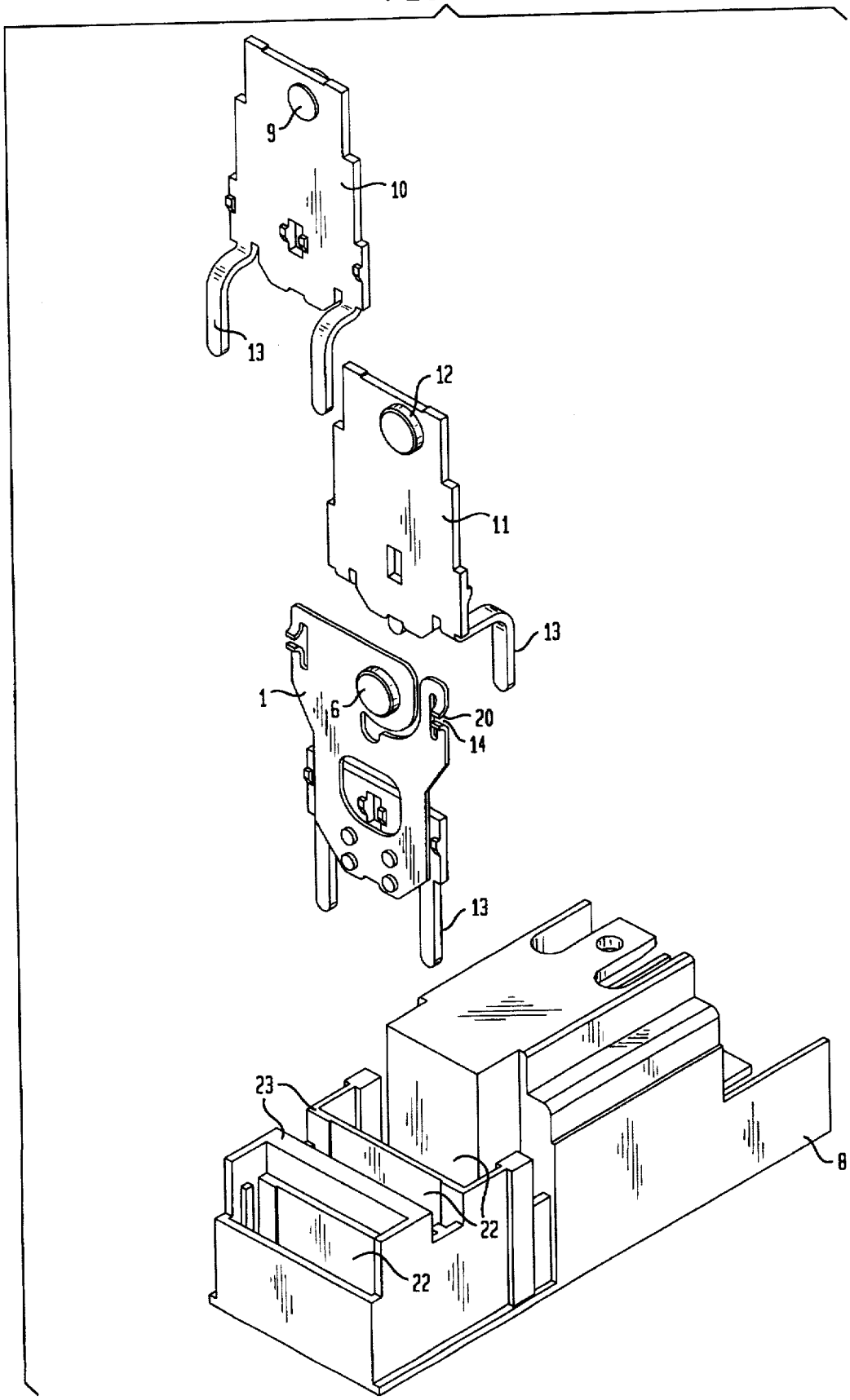
FIG. 12 is an exploded illustration off the relay of FIG. 1 illustrating in detail the contact spring and fixed contact carriers.

FIG. 12 shows an exploded view of the relay according to the present invention, and in particular the contact arrangement 4 with the moving contact spring 1 and the fixed contact carriers 10, 11. The base member 8 is provided at the end face that houses the contact arrangement 4 with partition walls 23 to define upwardly open compartments 22 for receiving the respective contact spring 1 and contact carriers 10, 11 and separating them from each other. In this manner, increased creeping current paths can be accomplished.

It will be appreciated by persons skilled in the art that in all embodiments of the contact spring 1 according to the present invention, the zones A, B can be suited to other in such a manner that an actuation of the contact spring 1, i.e. operation of the magnetic system, in particular of the armature 5, effects a substantially balanced loading of the magnetic system 5.

While the invention has been illustrated and described as embodied in a relay, it is not intended to be limited to the details shown since various modifications and structural changes may be made without departing in any way from the spirit of the present invention.

What is claimed as new and desired to be protected by Letters Patent is set forth in the appended claims:

1. A relay, comprising:

a base member;

a magnetic system mounted on said base member and including an armature;

a contact arrangement mounted on said base member and including a moveable contact spring defining a longitudinal axis and having one end secured to said base member, said contact spring being provided with a contact piece for contacting a fixed contact; and an actuating element coupled to said armature for transmitting armature movement to said contact spring, said actuating element being linked to said contact spring at two lateral attack points between which said contact spring has zones of different properties, said contact spring having formed therein an approximately rectangular hole positioned near said one end and extending symmetrical to said longitudinal axis and an aperture so extending between the contact piece and one of the attack points as to disengage the contact piece from said one attack point and thereby effect a roll-off motion of the contact piece upon the fixed contact during attraction of the armature through application of an asymmetric force of the actuating element on the contact piece and during release of the armature through return of the contact spring by an own spring force of the contact spring while substantially evenly loading said magnetic system.

2. The relay of claim 1 wherein the aperture partially encloses said contact piece.

3. The relay of claim 2, wherein the contact spring defines an upper end and a lower end, said aperture being formed by a cutout extending from the upper end of said contact spring and being open at said upper end.

4. The relay of claim 3, wherein the cutout is of L-shaped configuration as to extend from the upper end of said contact spring around said contact piece.

5. The relay of claim 3 wherein the cutout has another end that is enlarged and positioned beneath said contact piece.

6. The relay of claim 5 wherein said contact spring defines a longitudinal axis, said enlarged end of the cutout being asymmetrical with respect to the longitudinal axis of said contact spring.

7. The relay of claim 2, wherein the aperture is of generally C-shaped configuration to exhibit two spaced opposing sections between which said contact piece is positioned.

8. The relay of claim 2 wherein said contact piece is supported by a section of said contact spring that is at least partially enclosed by the aperture.

9. The relay of claim 8 wherein said contact spring defines a longitudinal axis, said section being positioned transversely to the longitudinal axis.

10. The relay of claim 1 wherein said contact spring is formed as substantially flat spring.

11. The relay of claim 1 wherein the attack points of said actuating element are formed by cutouts in the contact piece, with lugs being bent outwards in form of a bell flare.

12. The relay of claim 1 wherein said base member is divided by partition walls to form upwardly open compartments for receiving said contact spring and said fixed contact and separating them from each other.

13. The relay of claim 1 wherein said contact spring has a lower end and is secured to said base member by two legs formed laterally on said contact spring at the lower end.

14. The relay of claim 1 wherein said contact spring has a lower end and is secured to said base member by a central leg formed on said contact spring at the lower end.

15. The relay of claim 1 wherein said contact spring is defined by a longitudinal axis, said contact piece having a center positioned offset to the longitudinal axis of said contact spring.

16. The relay of claim 1 wherein the actuating element extends perpendicular to the contact spring.

17. The relay of claim 1 wherein the actuating element exhibits a forked configuration for engagement of the contact spring at the attack points.

18. The relay of claim 1, including two fixed contacts selectively contacted by the contact spring such that a roll-off motion of the contact piece is effected upon one of the fixed contacts through application of the asymmetric force of the actuating element on the contact piece during attraction of the armature and upon the other one of the fixed contacts during release of the armature and return of the contact spring by its own spring force while substantially evenly loading said magnetic system.

19. A relay, comprising:

a base member;

a magnetic system mounted on said base member and including an armature;

a contact arrangement mounted on said base member and including a moveable contact spring provided with a contact piece for contacting a fixed contact; and an actuating element coupled to said armature for transmitting armature movement to said contact spring, said actuating element being linked to said contact spring at two lateral attack points between which said contact spring has zones of different properties, said contact spring having formed therein an aperture so extending between the contact piece and one of the attack points as to disengage the contact piece from said one attack point and thereby effect a roll-off motion of the contact piece upon the fixed contact during attraction of the armature through application of an asymmetric force of the actuating element on the contact piece and during release of the armature through return of the contact spring by an own spring force of the contact spring while substantially evenly loading said magnetic system, said aperture partially enclosing said contact piece and being of generally C-shaped configuration to exhibit two spaced opposing sections between which said contact piece is positioned.

20. The relay of claim 19 wherein said contact piece is supported by a section of said contact spring that is at least partially enclosed by the aperture.

21. The relay of claim 20 wherein said contact spring defines a longitudinal axis, said section being positioned transversely to the longitudinal axis.

22. The relay of claim 19 wherein said contact spring is formed as substantially flat spring.

23. The relay of claim 19 wherein said contact arrangement includes fixed contact carriers, said base member being divided by partition walls to form upwardly open compartments for receiving said contact spring and said contact carriers and separating them from each other.

24. The relay of claim 19 wherein said contact spring is secured to said base member by two legs formed laterally on said contact spring at its lower end.

25. The relay of claim 19 wherein said contact spring is secured to said base member by a central leg formed on said contact spring at its lower end.

26. The relay of claim 19 wherein said contact spring is defined by a longitudinal axis, said contact piece having a center positioned offset to the longitudinal axis of said contact spring.

27. The relay of claim 19 wherein the actuating element extends perpendicular to the contact spring.

28. The relay of claim 19 wherein the actuating element exhibits a forked configuration for engagement of the contact spring at the attack points.

29. The relay of claim 19, including two fixed contacts selectively contacted by the contact spring such that a roll-off motion of the contact piece is effected upon one of the fixed contacts through application of the asymmetric force of the actuating element on the contact piece during attraction of the armature and upon the other one of the fixed contacts during release of the armature and return of the contact spring by its own spring force while substantially evenly loading said magnetic system.

30. A relay, comprising:

a base member;

a magnetic system mounted on said base member and including an armature;

a contact arrangement mounted on said base member and including a moveable contact spring provided with a contact piece for contacting a fixed contact and defining an upper end and a lower end; and an actuating element coupled to said armature for transmitting armature movement to said contact spring, said actuating element being linked to said contact spring at two lateral attack points between which said contact spring has zones of different properties, said contact spring having formed therein an aperture so extending between the contact piece and one of the attack points as to disengage the contact piece from said one attack point and thereby effect a roll-off motion of the contact piece upon the fixed contact during attraction of the armature through application of an asymmetric force of the actuating element on the contact piece and during release of the armature through return of the contact spring by an own spring force of the contact spring while substantially evenly loading said magnetic system, said aperture partially enclosing said contact piece and being formed by a cutout of L-shaped configuration as to extend from the upper end of said contact spring around said contact piece.

31. The relay of claim 30 wherein said contact piece is supported by a section of said contact spring that is at least partially enclosed by the aperture.

32. The relay of claim 31 wherein said contact spring defines a longitudinal axis, said section being positioned transversely to the longitudinal axis.

33. The relay of claim 30 wherein said contact spring is formed as substantially flat spring.

34. The relay of claim 30 wherein said contact arrangement includes fixed contact carriers, said base member being divided by partition walls to form upwardly open compartments for receiving said contact spring and said contact carriers and separating them from each other.

35. The relay of claim 30 wherein said contact spring is secured to said base member by two legs formed laterally on said contact spring at its lower end.

36. The relay of claim 30 wherein said contact spring is secured to said base member by a central leg formed on said contact spring at its lower end.

37. The relay of claim 30 wherein said contact spring is defined by a longitudinal axis, said contact piece having a center positioned offset to the longitudinal axis of said contact spring.

38. The relay of claim 30 wherein the actuating element extends perpendicular to the contact spring.

39. The relay of claim 30 wherein the actuating element exhibits a forked configuration for engagement of the contact spring at the attack points.

40. The relay of claim 30, including two fixed contacts selectively contacted by the contact spring such that a roll-off motion of the contact piece is effected upon one of the fixed contacts through application of the asymmetric force of the actuating element on the contact piece during attraction of the armature and upon the other one of the fixed contacts during release of the armature and return of the contact spring by its own spring force while substantially evenly loading said magnetic system.

41. A relay, comprising:

a base member;

a magnetic system mounted on said base member and including an armature;

a contact arrangement mounted on said base member and including a moveable contact spring provided with a contact piece for contacting a fixed contact and defining an upper end and a lower end; and an actuating element coupled to said armature for transmitting armature movement to said contact spring, said actuating element being linked to said contact spring at two lateral attack points between which said contact spring has zones of different properties, said contact spring having formed therein an aperture so extending between the contact piece and one of the attack points as to disengage the contact piece from said one attack point and thereby effect a roll-off motion of the contact piece upon the fixed contact during attraction of the armature through application of an asymmetric force of the actuating element on the contact piece and during release of the armature through return of the contact spring by an own spring force of the contact spring while substantially evenly loading said magnetic system, said aperture partially enclosing said contact piece and being formed by a cutout which extends from the upper end of said contact spring, is open at said upper end and has another enlarged end positioned beneath said contact piece.

42. The relay of claim 41 wherein said contact spring defines a longitudinal axis, said enlarged end of the cutout being asymmetrical with respect to the longitudinal axis of said contact spring.

43. The relay of claim 41 wherein said contact piece is supported by a section of said contact spring that is at least partially enclosed by the aperture.

44. The relay of claim 43 wherein said contact spring defines a longitudinal axis, said section being positioned transversely to the longitudinal axis.

45. The relay of claim 41 wherein said contact spring is formed as substantially flat spring.

46. The relay of claim 41 wherein said contact arrangement includes fixed contact carriers, said base member being divided by partition walls to form upwardly open compartments for receiving said contact spring and said contact carriers and separating them from each other.

47. The relay of claim 41 wherein said contact spring is secured to said base member by two legs formed laterally on said contact spring at its lower end.

48. The relay of claim 41 wherein said contact spring is secured to said base member by a central leg formed on said contact spring at its lower end.

49. The relay of claim 41 wherein said contact spring is defined by a longitudinal axis, said contact piece having a center positioned offset to the longitudinal axis of said contact spring.

50. The relay of claim 41 wherein the actuating element extends perpendicular to the contact spring.

51. The relay of claim 41 wherein the actuating element exhibits a forked configuration for engagement of the contact spring at the attack points.

52. The relay of claim 41, including two fixed contacts selectively contacted by the contact spring such that a roll-off motion of the contact piece is effected upon one of the fixed contacts through application of the asymmetric force of the actuating element on the contact piece during attraction of the armature and upon the other one of the fixed contacts during release of the armature and return of the contact spring by its own spring force while substantially evenly loading said magnetic system.

53. A relay, comprising:

a base member;

a magnetic system mounted on said base member and including an armature;

a contact arrangement mounted on said base member and including a moveable contact spring provided with a contact piece for contacting a fixed contact; and an actuating element coupled to said armature for transmitting armature movement to said contact spring, said actuating element being linked to said contact spring at two lateral attack points between which said contact spring has zones of different properties, wherein the attack points of said actuating element are formed by cutouts in the contact piece, with lugs being bent outwards in form of a bell flare, said contact spring having formed therein an aperture so extending between the contact piece and one of the attack points as to disengage the contact piece from said one attack point and thereby effect a roll-off motion of the contact piece upon the fixed contact during attraction of the armature through application of an asymmetric force of the actuating element on the contact piece and during release of the armature through return of the contact spring by an own spring force of the contact spring while substantially evenly loading said magnetic system.

54. The relay of claim 53 wherein said contact piece is supported by a section of said contact spring that is at least partially enclosed by the aperture.

55. The relay of claim 54 wherein said contact spring defines a longitudinal axis, said section being positioned transversely to the longitudinal axis.

56. The relay of claim 53 wherein said contact spring is formed as substantially flat spring.

57. The relay of claim 53 wherein said contact arrangement includes fixed contact carriers, said base member being divided by partition walls to form upwardly open compartments for receiving said contact spring and said contact carriers and separating them from each other.

58. The relay of claim 53 wherein said contact spring is secured to said base member by two legs formed laterally on said contact spring at its lower end.

59. The relay of claim 53 wherein said contact spring is secured to said base member by a central leg formed on said contact spring at its lower end.

60. The relay of claim 53 wherein said contact spring is defined by a longitudinal axis, said contact piece having a center positioned offset to the longitudinal axis of said contact spring.

61. The relay of claim 53 wherein the actuating element extends perpendicular to the contact spring.

62. The relay of claim 53 wherein the actuating element exhibits a forked configuration for engagement of the contact spring at the attack points.

63. The relay of claim 53, including two fixed contacts selectively contacted by the contact spring such that a roll-off motion of the contact piece is effected upon one of the fixed contacts through application of the asymmetric force of the actuating element on the contact piece during attraction of the armature and upon the other one of the fixed contacts during release of the armature and return of the contact spring by its own spring force while substantially evenly loading said magnetic system.

* * * * *